United States Patent [19]

Thornton

[11] 4,421,109

[45] Dec. 20, 1983

[54] METHOD AND APPARATUS FOR SIMULATING GRAVITATIONAL FORCES ON A LIVING ORGANISM

[75] Inventor: William E. Thornton, Friendswood, Tex.

[73] Assignee: The United States of America as represented by the Administrator of the National Aeronautics and Space Administration, Washington, D.C.

[21] Appl. No.: 414,106

[22] Filed: Sep. 2, 1982

[51] Int. Cl.[3] ..... A61H 7/00

[52] U.S. Cl. ..... 128/25 R; 128/1 A; 128/38

[58] Field of Search ..... 128/1 A, 202.12, 205.26, 128/24 R, 25 R, 30, 30.2, 38, 40, 44, 60

[56] References Cited

U.S. PATENT DOCUMENTS

| | | | |
|---|---|---|---|
| 726,791 | 4/1903 | Armbruster | 128/24 R |
| 2,531,074 | 11/1950 | Miller | 128/38 |
| 3,859,989 | 1/1975 | Spielberg | 128/24 R |

*Primary Examiner*—Henry J. Recla
*Attorney, Agent, or Firm*—Edward K. Fein; John R. Manning; Marvin F. Matthews

[57] ABSTRACT

A method and apparatus for simulating gravitational forces on a living organism wherein a series of negative pressures are externally applied to successive lengthwise sections of a lower limb of the organism, the pressures decreasing progressively with distance of said limb sections from the heart of the organism. A casing defines a chamber adapted to contain the limb of the organism and is rigidified to resist collapse upon the application of negative pressures to the interior of the chamber. Seals extend inwardly from the casing for effective engagement with the limb of the organism and, in cooperation with the limb, subdivide the chamber into a plurality of compartments each in negative pressure communicating relation with the limb. Controls apply negative pressures to the compartment and maintain the negative pressures at incrementally different levels in respective ones of the compartments.

17 Claims, 6 Drawing Figures

FIG. 1
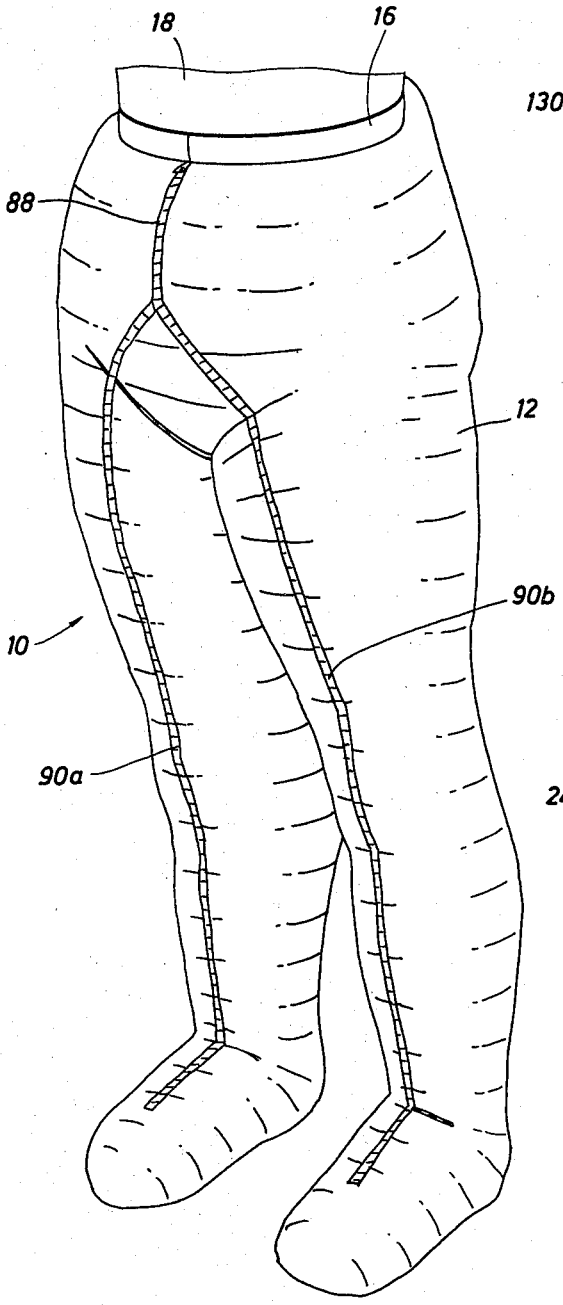
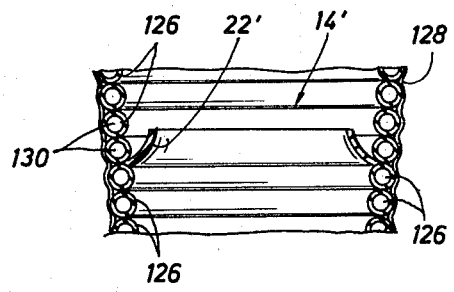
FIG. 6
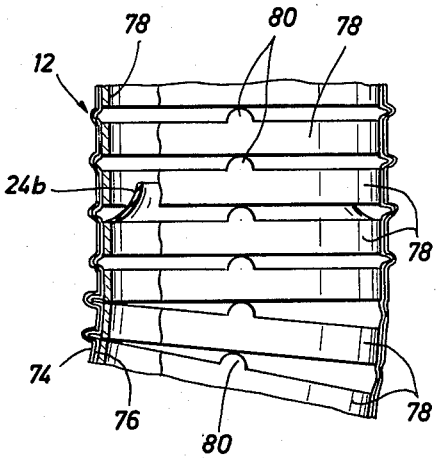
FIG. 3

METHOD AND APPARATUS FOR SIMULATING GRAVITATIONAL FORCES ON A LIVING ORGANISM

ORIGIN

The invention described herein was made by an employee of the U.S. Government and may be manufactured and used by or for the Government of the United States of America for governmental purposes without the payment of any royalties thereon or therefor.

BACKGROUND OF THE INVENTION

1. Field of the Invention

The present invention pertains to the simulation of gravitational forces on a living organism. More specifically, the invention provides a method and apparatus for simulating such forces on the circulatory system, typically of a human person, and particularly in the area located below the heart in an ordinary standing position. It can be readily appreciated that ordinary gravitational forces would, in the absence of some compensating mechanism, cause blood to accumulate or "pool" in the lower body, and especially the legs, of a standing human or other organism. To offset this tendency in the human, a number of anatomical and physiological mechanisms have evolved which either tend to resist downward shifts of fluid in those portions of the body and/or to enhance or assist upward flow. For example, the large veins in the legs of a human are surrounded with powerful muscles which tend to squeeze the enclosed vein and thereby urge the blood upwardly through a series of one way valves in those veins. Because the potential pooling problem is increased with distance from the heart, these mechanisms become more prevalent in the lower parts of the body. For example, the aforementioned one way valves in the vein increase in frequency toward the feet of a human being. Likewise, various muscles associated with the superficial veins become thicker with increasing distance from the heart to compensate for correspondingly increasing hydrostatic pressures.

The human person or other organism may be placed in situations in which the ordinary gravitational forces, which are counteracted by the aforementioned anatomical and physiological mechanisms, are not exerted. For example, if a person is bedridden or otherwise positioned with the legs outstretched generally horizontally, the tendency for gravity to cause pooling of the blood in the feet is virtually eliminated. Likewise, when a person leaves the earth's atmosphere, as in space flight, the "weightlessness" which is experienced is, per se, an absence of the ordinary gravitational forces, and occurs regardless of the position of the person.

Accordingly, it may be desirable to simulate ordinary gravitational forces on such persons. For example, when these gravitational forces are absent for an extended period of time, e.g. during space flights or a lengthy illness, several effects occur which in turn inhibit the resumption of normal functioning of the aforementioned mechanisms for resisting blood pooling. For example, after a period of weightlessness, the body will have readjusted the quantity and distribution of blood in the circulatory system, so that there will be a relatively low volume of blood in general accompanied by abnormally low concentrations of blood in the lower trunk, legs and feet. Then, when the earth's atmosphere is reentered, the body must attempt to return to a normal distribution of blood throughout the lower body area, with overall reserves depleted. This subjects the astronaut to physical stress at a time when other demands are high and such stress can least be tolerated. Even more seriously, where a person has remained bedridden for an extremely long period of time, or should an astronaut remain in space for a comparable length of time, the body's aforementioned anatomical and physiological gravity-counteracting mechanisms may atrophy through nonuse.

It is therefore desirable to be able to simulate the normal gravitational forces while the person is bedridden or in a weightless condition to eliminate such problems. In still other instances, it may be desirable to simulate normal gravitational forces, either on earth or in space, for scientific or experimental purposes.

2. Description of the Prior Art

Several prior devices are known for simulating gravitational forces by applying a negative pressure to the lower portion of the body of a person. One such device incorporated a rigid, stationary cabinet into which the person would insert his lower body. It was then necessary to remain in the cabinet, effectively immobilized, for a suitable length of time for application of the negative pressure. Another device, developed in the U.S.S.R., was "portable" in that it included a somewhat trouser-like garment permitting at least some movement by the user while the negative pressure was being applied.

Aside from their cumbersome nature and undue complexity, both of these types of devices suffer from a major problem in that they apply a single, constant value negative pressure to the entire portion of the body being treated, e.g. from the chest or waist to the feet. This is not only a highly inaccurate simulation of normal gravitational forces, which produce a gradient of hydrostatic pressures from the heart to the feet of a standing person, but introduces other related problems. For example, in order to avoid subjecting the lower trunk of the person to a harmfully low pressure, it was necessary to select a pressure value which was not low enough to be suitably beneficial to the area of the lower limbs, ankles and feet. Even so, it was necessary to attempt to provide extremely accurate pressure value controls, and such controls had to be meticulously monitored to ensure against cardiovascular disturbances. Furthermore, even when selected at a safe level, e.g. −50 mm Hg, such a constant pressure value, representing a compromise between appropriate values for the trunk area and foot area, represented a relatively large pressure differential as compared to the atmospheric pressure existing outside the body enclosure. If then became difficult to adequately seal the enclosure with respect to the person's body, without causing discomfort or undue constriction of the body, and also necessitated relatively high capacity pumps for applying and maintaining the negative pressure.

A number of other prior devices are diametrically opposed to the present invention, in both purpose and operation. Examples of such devices are disclosed in U.S. Pat. No. 3,548,809; No. 2,531,074; No. 4,029,087; No. 2,495,316; No. 3,574,236; No. 3,659,593; No. 3,862,629; No. 4,066,084; and No. 4,270,527. Each of the devices disclosed in these patents is intended not to simulate ordinary gravitational forces, but rather, to simulate or enhance the counteractive mechanisms of the body. Typically, these devices apply a positive pressure or compressive force to the body, sometimes with a pulsing, rippling or massage-like action. Furthermore, the devices are, in general, incapable of applying negative pressures to a portion of a body for several reasons. In the first place, the bladders or the like to which the positive pressures are applied would simply collapse if subjected to negative pressures. Furthermore, these bladders are not in effective direct fluid communication with the person's body, but rather represent separate sealed compartments which may be inflated so that their exterior surfaces abut the body to indirectly transmit compressive forces only. Thus, even if negative pressures could somehow be applied to these bladders without their collapse, these negative pressures would not be communicated to the adjacent leg or other body portion.

Still another prior technique for simulating gravitational forces involved increasing the internal blood pressure of the organism, as by applying carefully controlled compressive loads to the thoracic area, and then counteracting this increased internal pressure with positive pressures applied externally to the legs. While this system produces a very accurate simulation of normal gravitational forces on a standing organism, it is complicated, expensive, potentially dangerous, and generally inappropriate for uses other than scientific experimentation.

SUMMARY OF THE INVENTION

The present invention provides a method and apparatus in which a series of negative pressures are externally applied to successive lengthwise sections of at least a lower limb, and preferably both legs and the lower trunk. The pressures decrease progressively with distance of these sections from the heart. The apparatus comprises a casing defining a chamber adapted to contain the appropriate portion of the body of the person or other organism. This casing is rigidified to resist collapse upon the application of negative pressures to the interior of the chamber. Seals extend inwardly from the casing for effective engagement with the enclosed portion of the body and, in cooperation with the body, subdivide the chamber into a plurality of compartments each in negative pressure communicating relation with the adjacent part of the body. Control means apply negative pressures to the compartments and maintain the pressures at incrementally different levels in respective ones of the compartments.

The seal means are arranged to lie generally transverse to the limbs and trunk, whereby the aforementioned compartments are disposed at respectively increasing distances from the heart. The casing preferably forms a trouser-like garment whereby the chamber may contain both legs and a portion of the trunk of the person.

The advantages of the present invention are numerous. Because the compartments progress generally lengthwise along the body, with pressures decreasing from one compartment to the next with distance from the heart, a number of advantages are obtained. Firstly, this arrangement represents a much more accurate simulation of the effects of normal gravitational forces on the body. In fact, the succession of relatively small pressure differentials effectively produces a gradient from the trunk to the feet. The approximation of this gradient of negative external pressures to the normal gradient of hydrostatic pressures in the lower body of a standing person in the earth's atmosphere may be rendered more and more accurate depending upon the number of compartments employed. In any event, even with a relatively low number of compartments, an effective gradient, or gradient simulation, may be produced.

This not only enhances the ability of the device to return the circulatory system to its normal condition, but also renders it safer and simpler. It becomes possible to use a relatively high and, therefore, safe pressure value in the trunk area, while simultaneously using a much lower pressure about the lower legs and feet than was previously possible. This eliminates danger to the former area, while enhancing the beneficial effects on the latter. The seal between the casing generally and the external atmosphere occurs at the upper end, about the person's trunk. The pressure differential between the adjacent uppermost compartment and the external atmosphere is relatively low. Likewise, the differentials between each two adjacent compartments are correspondingly low. Thus, it is not necessary for any of the various seal means to engage the person's body so tightly as to cause discomfort or harmful constriction. On the contrary, it is permissible, and even desirable, to design the seals to permit a small amount of leakage, as the device as a whole in effect acts like a labyrinth type seal helping to maintain the successive pressure differentials which together comprise the simulated pressure gradient. Similarly, the upper portion of the casing requires the least amount of rigidity, and this fact cooperates beneficially with the fact that this is the area in which such rigidity could potentially cause the most discomfort or inconvenience.

Accordingly, it is a principal object of the present invention to provide an improved method and apparatus for simulating gravitational forces on a living organism.

Another object of the present invention is to provide such a method and apparatus in which a series of negative pressures are externally applied to successive lengthwise sections of a lower limb of such an organism, the pressures decreasing progressively with distance of said limb sections from the heart.

Still another object of the present invention is to provide a trouser-like garment in which an effective lengthwise negative pressure gradient may be created.

A fruther object of the present invention is to provide such a method and apparatus which is simultaneously safer and more accurate and effective than prior methods.

Still other objects, features, and advantages of the present invention will be made apparent by the following detailed description, the drawings, and the claims.

BRIEF DESCRIPTION OF THE DRAWINGS

FIG. 1 is a perspective view of a garment according to the present invention.

FIG. 3 is a detailed sectional view through a section of one leg of the garment.

FIG. 6 is a view similar to that of FIG. 3 showing an alternative rigidifying means.

DETAILED DESCRIPTION

Figure 2:
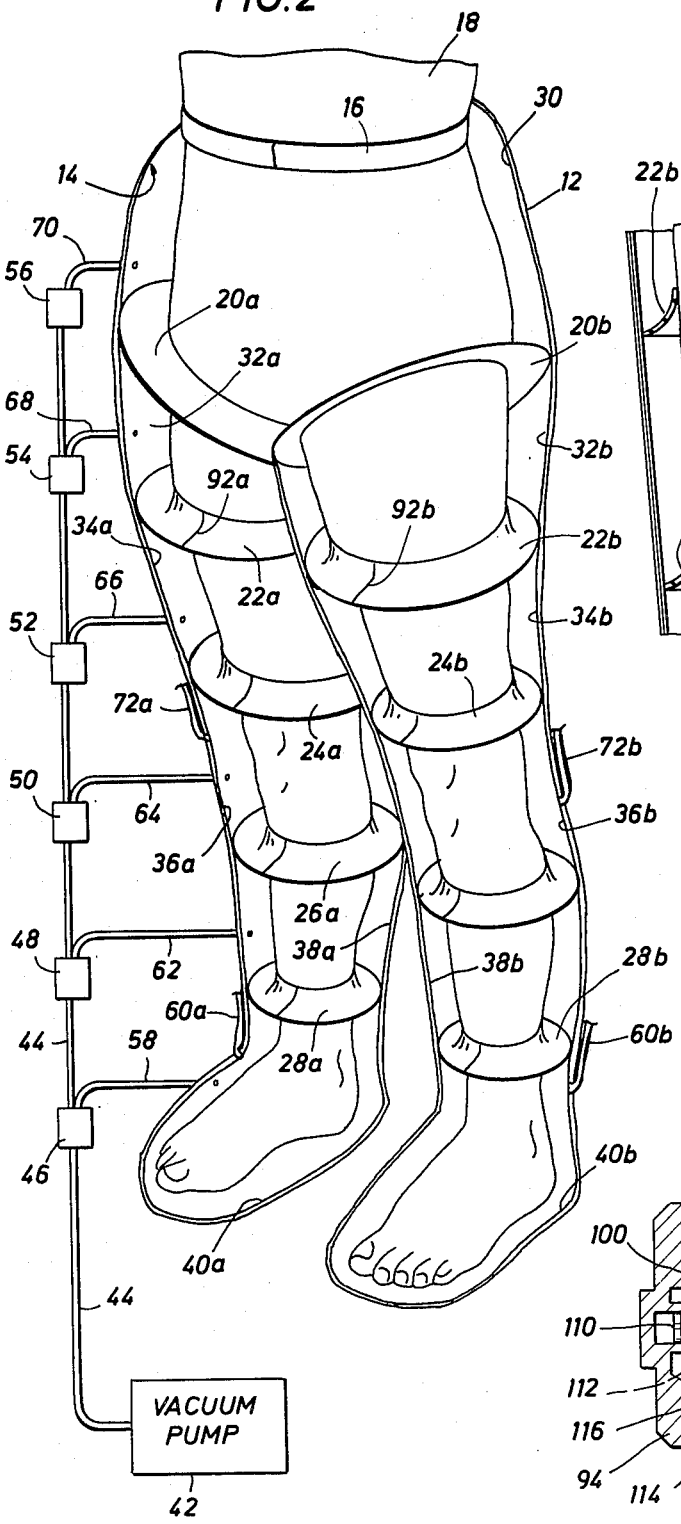
FIG. 2 is a diagrammatic cross-sectional view through the garment of FIG. 1 and showing associated therewith control means, conduit means, and seal means.

The apparatus of the present invention comprises a trouser-like garment 10 comprised of a casing 12 which defines an internal chamber 14. The casing 12, as will be described more fully below, may be comprised of one or more layers of relatively flexible material and, as a whole, is substantially fluid tight. Casing 12 is further rigidified, in any suitable manner examples of which will be described more fully below, so that chamber 14 will not collapse when a vacuum or negative pressure is applied thereto. At the upper end of casing 12, there is integrally attached a waistband 16 which sealingly engages the trunk 18 of the user's body. To enhance its sealing effect, waistband 16 may be formed of or internally lined with a relatively soft elastomeric material.

A plurality of seal bands 20*a*–28*a* and 20*b*–28*b* extend inwardly from the casing 12 to sealingly engage the user's body, and in conjunction therewith, to subdivide chamber 14 into a number of compartments 30, 32*a*–40*a*, and 32*b*–40*b*. A reference numeral used with the suffix "a" will denote a seal, compartment or other element disposed on the right side of the user's body, and a like reference numeral with the suffix "b" will designate a seal or compartment located in a corresponding position on the left side of the user's body.

The seals 20*a*–40*a* and 20*b*–40*b* extend generally transversely with respect to the longitudinal dimension of garment 10 and, more specifically, to the leg portions thereof, so that the various compartments of each leg are disposed at respectively increasing distances from the uppermost or trunk compartment 30 and, thus, from the heart of the user. In the embodiment shown, the various compartments represent six increments of distances from the user's heart. More specifically, upper compartment 30 represents a trunk compartment for containing the lower portion of the trunk 18 of the user. Seals 20*a* and 20*b* encircle the upper legs of the user, closely adjacent his trunk, to divide trunk compartment 30 from respective upper thigh compartments 32*a* and 32*b*. The next increment or level is represented by lower thigh compartments 34*a* and 34*b*, followed by knee compartments 36*a* and 36*b*, calf compartments 38*a* and 38*b*, and angle-foot compartments 40*a* and 40*b*.

Although the number of seals and compartments may be varied, it is desirable that the seals not be disposed directly about the knees or ankles of the user, but rather, that they be spaced from the joints, not only to enhance the user's mobility, but also to avoid undue interference with proper sealing as the user moves about.

The control means for applying and maintaining the negative pressures to the various compartments of the apparatus is diagrammatically illustrated in FIG. 2. The control means includes a suitable vacuum pump 42, a suction line 44 from pump 42 communicates with a first pressure regulator 46 and also extends away from regulator 46 to communicate with additional pressure regulators 48–56. Thus, regulators 46–56 are connected in parallel by line 44. Each of the pressure regulators in turn communicates with the compartment or compartments at a respective level or incremental distance from the heart of the user.

More specifically, regulator 46 communicates via line 58 with the lowermost or foot-ankle compartment 40*a* on the right side. A conduit, one end of which is shown at 60, communicates with the interior of compartment 40*a* and extends upwardly therefrom, along the exterior of garment 10, rearwardly about the trunk portion of the garment, and thence downwardly along the exterior of the left leg to a point where its other end, 60*b*, enters and communicates with corresponding foot-ankle compartment 40*b*. Thus, regulator 46 is communicated with both of the lowermost compartments 40*a* and 40*b*.

Similarly, regulator 48 communicates by a line 62 with compartment 38*a*; regulator 50 communicates by a line 64 with compartment 36*a*, regulator 52 communicates by a line 66 with compartment 34*a*; regulator 54 communicates by a line 68 with compartment 32*a*, and regulator 56 communicates by a line 70 with upper compartment 30. For each of the compartments 32*a*–40*a* on the right side, there is a conduit for interconnecting or communicating that compartment with the compartment at the corresponding level on the left side. As mentioned, one example of such a conduit is shown at 60*a* and 60*b*. Portions of another such conduit are shown at 72*a* and 72*b* for interconnecting knee compartments 36*a* and 36*b*. The remaining such conduits have been omitted from the drawing for clarity of illustration.

The regulator 46 located closest to vacuum pump 42 maintains a pressure in compartments 40*a* and 40*b* which is relatively low, e.g. on the order of −90 mm Hg. Successive regulators 48–56 maintain the pressures in their respective compartments at successively higher negative pressures, so that a series of negative pressures are applied to successive lengthwise portions of garment 10. Because each compartment of garment 10 is in negative pressure communicating relation, and more specifically in fluid communication, with the adjacent part of the user's body, said series of negative pressures are thereby externally applied to successive lengthwise portions of the user's body. In other words, a negative pressure gradient is effectively created along the lower body of the user, and such gradient effectively simulates or serves as a substitute for the ordinary gravitational forces which would act on that body if the user were in a standing position on earth.

As previously mentioned, the casing 12 must be rigidified in order to resist collapse as negative pressures are applied to the compartments therein. This may be done in any number of ways, one example of which is illustrated in FIG. 3. As shown in FIG. 3, the casing 12 may be comprised of two layers of material 74 and 76. Outer layer 74 may be a suitable heavy duty fabric, which may be impregnated or otherwise treated with sealants, stiffening agents, and the like. Inner layer 76 is preferably a fluid tight layer, which may be comprised of, for example, a natural or synthetic elastomer or a suitable polymer. The use of such material on the inner layer permits other elements of the apparatus to be readily bonded thereto. For example, one of the elastomeric seals, to be described more fully below, is shown at 24*b* as bonded to inner casing layer 76.

Also attached to layer 76 are a series of stiffener members in the form of ring-like stays 78. Stays 78 may be affixed to casing 12 in any suitable manner, e.g. bonding, tack stitching, etc. These stays may be formed of any suitable material, such as a lightweight metal or plastic. While sufficiently rigid to resist collapse under the anticipated negative pressures, the stays 78 are preferably made as light and flexible as possible to enhance the comfort of the user. Stays 78 are ring-like in form, and thereby inherently resist lateral collapse of the attached casing 12. In addition, ech stay 78 has a pair of diametrically opposed knuckles or projections, one of which is shown at 80 on each of the stays in FIG. 3, extending upwardly therefrom to abut the underside of the next adjacent stay. Knuckles 80 support the stays, and thus the attached casing, with respect to one another in a longitudinal direction, while still providing pivot points to allow flexing of the user's joints as shown in the lower portion of FIG. 3.

FIG. 3 represents a relatively lower section of one leg of the garment. Because the pressure in this area in use is relatively low, a relatively large amount of reinforcing or rigidifying material per unit area of the casing 12 is required. However, in upper portions of the garment, specifically near the trunk and upper thighs, the pressures are higher, and progressively less reinforcement is required. Thus, in these upper sections of the garment, where flexibility is all the more desirable for comfort in use, the number and/or size of the stays may be reduced, with the lengthwise dimensions of the knuckles on those stays being correspondingly enlarged to provide the necessary longitudinal abutment.

Figure 4:
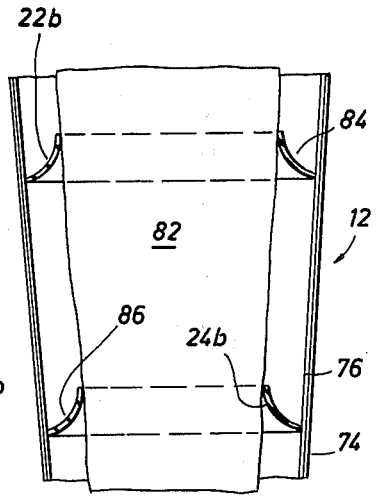
FIG. 4 is a detailed longitudinal sectional view through a section of one leg of the garment with the rigidifying means removed and the seal means shown in engagement with the leg of the user.

Referring now to FIG. 4, a section of one leg of garment 12 is shown with the user's leg 82 engaged therein, but with the rigidifying members removed for clarity of illustration. FIG. 4 more clearly illustrates the form of two of the seals 22*b* and 24*b*. As mentioned, these seals may be bonded to inner layer 76 of casing 12, or they may be formed integrally therewith of the same material. Seals 22*b* and 24*b*, like the other seals more generally shown in FIG. 2, are preferably in the form of flanges which extend generally laterally inwardly but which are also curved longitudinally upwardly so as to be concave upwardly as shown. The material of which seals 22*b* and 24*b* are formed must be sufficiently firm to tend to retain its general concave upturned configuration, but at the same time, should be sufficiently soft, flexible, and stretchable to accommodate the user's leg 82 and its movement without causing undue constriction and while still maintaining an adequate seal. Various natural or synthetic elastomers may be suitable.

It is important to note that it is not necessary for the seals 22*b* and 24*b*, nor any of the other seals, to maintain a perfect fluid tight sealing engagement with the user's body. This is likewise true of the waistband seal 16 located at the upper extremity of garment 12. As mentioned, the pressure within the uppermost compartment 30 differs from the adjacent atmospheric pressure by a relatively small increment. Likewise, the pressures between each two successive compartments within the garment differ by relatively small increments. Thus, because of the absence of a large pressure differential across any one individual seal, there is less tendency for drastic leakage. Furthermore, due to the relatively small incremental differences in pressure between the plural compartments, the garment as a whole effectively acts as a labyrinth type seal. Limited leakage through the various seals is not only tolerable, but may in fact facilitate operation of the pressure regulators 46–56. Thus, if the relationship between a given seal and a user's body is such that only such tolerable limited leakage is permitted, e.g. where a light non-fluid-tight inner garment is interposed between the user's body and the seal, the seal will still be said to be in "effective sealing engagement" with the user's body for purposes of the present invention.

It should also be noted that the upwardly concave formation of the seals tends to form fluid-receiving pockets such as 84 and 86 which receive fluid tending to leak downwardly and urge the respective seals into tighter engagement with the user's body with a self-energizing effect.

In order to prevent the desired orientation of the seals from being disturbed when the user dons the garment 10, such as might occur if he simply stepped into the garment from the upper end, suitable closure means are preferably provided extending generally lengthwise along the garment. For example, as shown in FIG. 1, a series of gas tight zippers, well known in the aerospace arts, may be provided. These zippers would include a first run 88 extending generally lengthwise along the front of the trunk portion of the garment and intersecting parallel runs 90*a* and 90*b* extending along respective legs of the garment. The seals are designed to be parted adjacent the zippers as indicated by the slits shown, for example at 92*a* and 92*b*, in FIG. 2. The edges adjacent these slits may be provided with dovetail formations for reestablishment of proper sealing conditions after the slits have been parted and rejoined. In any event, as mentioned above, limited leakage is acceptable, and even preferable, due to the nature of the apparatus.

Figure 5:
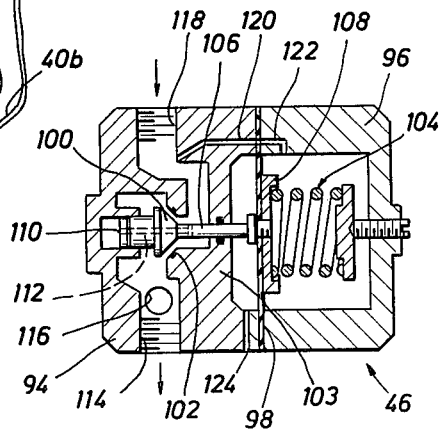
FIG. 5 is an enlarged cross-sectional view through one of the pressure regulators.

Pressure regulators 46–56 may be of any suitable form, one example of which is shown in FIG. 5. There the regulator 46 is shown as comprising a housing having two halves 94 and 96, which may be joined in any well known manner, such as by bolts (not shown). The interior of the housing is divided by a flexible diaphragm 98 clamped between housing halves 94 and 96. On one side of diaphragm 98, specifically within housing part 94, is a valve assembly including a reciprocable frustoconical valve element 100 cooperating with a corresponding frustoconical seat 102 formed on housing part 94. On the other side of diaphragm 98, specifically in housing part 96, there is a compression spring assembly 104 tending to urge valve element 100 to its open position as shown. Integrally secured to valve element 100 is a principle guide stem 106 which extends through a guide bore in an internal wall 103 extending across housing part 94 and is sealed with respect to said bore. At its outer end, stem 106 is connected by a bolt assembly, sealed with respect to diaphragm 98, to a bearing plate 108 located on the opposite side of diaphragm 98 and engaged by one end of spring 104. Extending from the other end of valve element 100 is a second cylindrical guide member 110 which is received in a cylindrical recess in the end of housing part 94 and sealed with respect thereto. In a well known manner, pressure equalizing passages 112 are formed through the valve element 100 and its stems to equalize pressures on opposite sides of stem 110, and the adjacent valve element 100, thereby preventing these parts from effectively acting as a piston affecting the position of the valve element.

The portion of housing part 94 which receives the valve element 100 communicates with a threaded bore 114 whereby line 44 from vacuum pump 42 is connected to the pressure regulator 46. Another bore 116 intersects bore 114 to receive a continuation of line 44 extending to the next adjacent pressure regulator 48. Bore 114 intersects the central portion of the housing on the downstream side of valve seat 102. Another bore 118, which receives line 58 in use, communicates with the central interior area of the housing on the opposite or upstream side of valve seat 102. Bore 118 is in fluid pressure communicating relation with the chamber formed on the opposite side of diaphragm 98, i.e. within housing part 96, via bleed ports 120 and 122, in housing parts 94 and 96 respectively, and an aligned bore in diaphragm 98 therebetween. The opposite side of diaphragm 98 is vented to atmosphere by a vent port 124 in housing part 94.

In operation, spring assembly 104 normally urges valve 100 to its open position, as shown, whereby bores 114 and 118 communicate with each other across valve seat 102. Thus, the vacuum pump 42 connected to bore 114 via line 44 will evacuate fluid from compartment 40*a*, which is communicated with bore 118 by line 58. Pressure in housing part 96 will decrease simultaneously with the decreasing pressure in compartment 40*a*. In other words, a vacuum will be created in the interior of housing part 96. Spring assembly 104 is chosen to maintain the valve in open position at pressures above some predetermined magnitude. When the negative pressure being applied to compartment 40*a* and housing part 96 reaches or drops below that predetermined value, the vacuum in housing part 96 acting on diaphragm 98 will overcome the force of spring assembly 104 and move valve element 100 into engagement with seat 102 thereby closing the valve and preventing further reduction in prressure by blocking pump 42, line 44 and bore 114 from communication with bore 118, line 58 and compartment 40*a*. As fluid gradually leaks past seal 28*a*, the pressure in compartment 40*a* will increase. When that pressure exceeds the value determined by spring assembly 104, the latter will overcome the force of the vacuum acting on diaphragm 98 and will reopen the valve assembly, thereby permitting renewed communication with pump 42 to return the pressure in compartment 40*a* to the desired negative value. The pressure in compartment 40*b* will simultaneously be regulated in the same manner due to the communication of compartments 40*a* and 40*b* with each other through conduit 60*a*, 60*b*.

Because bores 114 and 116 are located on the same side of valve seat 102, the portions of line 44 above and below regulator 46 will remain in communication regardless of the position of the valve element. Each of the regulators 48–56 is of substantially the same form as regulator 46 except that: (1) the springs for the various regulators are of different strengths, corresponding to the different negative pressures to be maintained by the respective regulators; and (2) upper regulator 56 has no bore 116. Because the regulators are connected to line 44 in parallel, each may act independently of the others. Thus, if one regulator should stick or otherwise malfunction, an effective pressure gradient will still be maintained along the length of the garment, particularly due to the labyrinth seal effect of the garment construction as described hereinabove.

The effective pressure gradient along the garment proceeds from a maximum pressure in the range of −12 to −30 mm Hg in compartment 30 to a minimum pressure in the range of −80 to −150 mm Hg in compartments 40*a* and 40*b*. More specifically, the pressure in trunk compartment 30 is preferably on the order of −15 mm Hg. The pressures in each successive level or pair of leg compartments decrease by approximately −15 mm Hg so that compartments 32*a* and 32*b* are maintained at approximately −30 mm Hg; compartments 34*a* and 34*b* are maintained at approximately −30 mm Hg; compartments 36*a* and 36*b* are maintained at approximately −60 mm Hg; compartments 38*a* and 38*b* are maintained at approximately −75 mm Hg; and compartments 40*a* and 40*b* are maintained at approximately −90 mm Hg. This effective gradient, including six incremental decreases in pressure, represents a fairly good approximation of the effects of gravitational forces without undue complication of the apparatus. However, acceptable results can be obtained, with even further simplification of the apparatus, by using fewer compartments and slightly greater increments of decreasing pressure; while an even closer approximation of true gravitational forces can be obtained by increasing the number of compartments and correspondingly decreasing the size of the incremental pressure differences between compartments.

It should be further noted that, because of the labyrinth seal effect of the garment, a relatively low volume pump can be used to maintain even the low negative pressures in lower compartments 40*a* and 40*b*.

Referring finally to FIG. 6, there is shown an alternative means of rigidifying the garment casing. Specifically, a cross section through one leg of the garment is shown. It will be understood that the other leg and the trunk portion would be similarly formed. In particular, the casing comprises a stack of hollow rings 126. These rings may be bonded or otherwise suitably joined and sealed to one another by any means well known in the art. To further ensure structural integrity as well as sealing of the rings to one another, the stack of rings as a unit may be encompassed within an outer sheath 128. Each of the rings 126 has an annular internal cavity 130, and cavities 130 are filled with a positive pressurized fluid. This application of positive pressure rigidifies the casing formed by rings 126 while still permitting some flexibility. It is important to note that the cavities 130 to which the aforementioned positive pressure is applied are completely separate from the internal chamber 14' defined by the stack of rings as a whole. In conjunction with the user's body received therein, seals such as 22', which are similar to those of the preceding embodiment, subdivide chamber 14' into compartments which are separate from and in no way communicate with cavities 130. Rather, these compartments are, as in the preceding embodiment, in negative pressure communicating relation with the exterior of the user's body. Seals such as 22' may be sandwiched between a pair of adjacent rings 126 and further bonded and sealed thereto by a suitable adhesive or the like.

Numerous modifications of the exemplary embodiments described above are possible within the spirit of the invention. For example, both the seal means and the means for rigidifying the garment casing may take numerous other forms than the examples shown and described herein. Other variations might involve changes in the control means for applying and maintaining the negative pressures. For example, for convenience of illustration, the pressure regulators have been shown in FIG. 2 as separate from the garment 10. In practice, these regulators and the associated fluid flow lines may be affixed to the exterior or the interior of the garment for convenience of the user, with the pump also being carried on the garment, or in the alternative, connected to the lowermost regulator by an extensible flexible line. While the regulators have been shown and described as connected in parallel, other systems are possible. For example, the regulators might advantageously be connected in series. This would reduce total leakage through the system and might also permit the use of simplified regulators. It would also be possible to provide separate regulators for each side or leg of the garment. Still other modifications will suggest themselves to those of skill in the art. Accordingly, it is intended that the scope of the invention be limited only by the claims which follow.

We claim:

1. Apparatus for simulating aspects of gravitational forces on at least a portion of a living organism comprising:

casing means defining a chamber adapted to contain a portion of the body of said organism, said casing means being rigidified to resist collapse upon application of negative pressure to the interior of said chamber;

seal means extending inwardly from said casing means for effective engagement with said body portion and, in cooperation with said body portion, subdividing said chamber into a plurality of compartments each in negative pressure communicating relation with an adjacent part of said body portion;

and control means for applying negative pressures to said compartments and for maintaining said negative pressures at incrementally different levels in respective ones of said compartments.

2. The apparatus of claim 1 wherein said casing means is configured to adapt said chamber for containing at least a part of one lower limb of said organism, said seal means being arranged to lie generally transverse to said limb, whereby said compartments are disposed at respectively increasing distances from the heart of said organism in use.

3. The apparatus of claim 2 wherein said casing forms a trouser-like garment whereby said chamber may contain both legs and a portion of the trunk of a human.

4. The apparatus of claim 3 wherein said casing means is comprised of a flexible, fluid-tight material, said apparatus further comprising stiffener means associated with said casing for so rigidifying said casing.

5. The apparatus of claim 4 wherein said stiffener means is auticulated to permit movement of the body of said human when contained in said chamber.

6. The apparatus of claim 3 wherein said control means and said seal means are operative to maintain a maximum pressure in the range of −12 to −30 mm Hg adjacent the trunk of said human, a minimum pressure in the range of −80 to −150 mm Hg adjacent the feet of said human, and an effective gradient from said maximum pressure to said minimum pressure along the legs of said human.

7. The apparatus of claim 6 wherein said maximum pressure is on the order of −15 mm Hg, and said minimum pressure is on the order of −90 mm Hg.

8. The apparatus of claim 3 wherein said seal means further includes a body seal for sealing the upper end of said casing about the trunk of said human.

9. The apparatus of claim 8 wherein said compartments include at least one trunk compartment for disposition about the trunk of said human and a plurality of leg compartments for disposition about successive lengthwise parts of each leg of said human.

10. The apparatus of claim 9 wherein said seal means are positioned on said garment so as to be spaced from the knee and ankle areas of said human in use.

11. The apparatus of claim 9 further comprising fluid tight closure means extending generally in the trunk-to-foot direction along said casing means, and including at least one run extending lengthwise along each leg of said casing, for permitting donning and doffing of said garment.

12. The apparatus of either claim 2 or claim 8 wherein said seal means are adapted to permit limited leakage.

13. A method of simulating aspects of gravitational forces on at least a portion of a living organism comprising applying a series of negative pressures externally to successive lengthwise sections of a lower limb of said organism, said pressures decreasing progressively with distance of said limb sections from the heart of said organism.

14. The method of claim 13 wherein said organism is human, and wherein said pressures are applied to both of the legs and the lower trunk of said human.

15. The method of claim 14 wherein a maximum pressure in the range of −12 to −30 mm Hg is maintained adjacent the trunk of said human, a minimum pressure in the range of −80 to −150 mm Hg is maintained adjacent the feet of said human, and an effective gradient from said maximum pressure to said minimum pressure is maintained along the legs of said human.

16. The method of claim 15 wherein said maximum pressure is on the order of −15 mm Hg, and said minimum pressure is on the order of −90 mm Hg.

17. The method of claim 14 wherein said pressures are applied during a space flight shortly prior to reentry into the earth's atmosphere.

* * * * *